US009126807B2

(12) United States Patent
Stanley et al.

(10) Patent No.: US 9,126,807 B2
(45) Date of Patent: Sep. 8, 2015

(54) ELEVATOR DISPATCH CONTROL TO AVOID PASSENGER CONFUSION

(75) Inventors: Jannah A. Stanley, Portland, CT (US); Ashley Kaminski, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 569 days.

(21) Appl. No.: 13/634,398

(22) PCT Filed: Apr. 12, 2010

(86) PCT No.: PCT/US2010/030678

§ 371 (c)(1), (2), (4) Date: Sep. 12, 2012

(87) PCT Pub. No.: WO2011/129803

PCT Pub. Date: Oct. 20, 2011

(65) Prior Publication Data

US 2013/0001021 A1 Jan. 3, 2013

(51) Int. Cl.
*B66B 1/16* (2006.01)
*B66B 1/24* (2006.01)

(52) U.S. Cl.
CPC ..... *B66B 1/2458* (2013.01); *B66B 2201/102* (2013.01); *B66B 2201/103* (2013.01); *B66B 2201/211* (2013.01); *B66B 2201/213* (2013.01); *B66B 2201/216* (2013.01)

(58) Field of Classification Search
CPC ..... B66B 1/2458; B66B 2201/102; B66B 2201/103; B66B 2201/211; B66B 2201/213; B66B 2201/216
USPC ..... 187/247, 380–389, 391–393
See application file for complete search history.

(56) References Cited

U.S. PATENT DOCUMENTS 3,374,864 A 3/1968 Port
3,586,133 A 6/1971 Santyslak
(Continued)

FOREIGN PATENT DOCUMENTS

JP 59-118669 7/1984
JP 7277609 A 10/1995
(Continued)

OTHER PUBLICATIONS

International Preliminary Report on Patentability for International application No. PCT/US2010/030678 dated Oct. 26, 2012.
(Continued)

*Primary Examiner* — Anthony Salata
(74) *Attorney, Agent, or Firm* — Carlson, Gaskey & Olds

(57) ABSTRACT

An exemplary method of controlling an elevator system includes determining a source floor of a new call from a passenger desiring elevator service. A direction of travel from the source floor for the new call is also determined. A path of a considered elevator car is simulated as if the new call were assigned to the considered elevator car by determining at least one of (i) a relationship between a position of the considered elevator car and the source floor or (ii) a relationship between a direction of movement of the considered elevator car and the direction of travel. The new call is assigned to one of a plurality of elevator cars if the assigning will satisfy each of (i) the one of the elevator cars will not move in a direction opposite the direction of travel during a time between the passenger boarding the one of the elevator cars and arriving at a destination of the passenger and (ii) the one of the elevator cars will not move in a direction opposite a travel direction of any currently assigned passenger during a time between the currently assigned passenger boarding the one of the elevator cars and arriving at a destination of the currently assigned passenger.

17 Claims, 5 Drawing Sheets

(56) References Cited

U.S. PATENT DOCUMENTS

| | | | | | |
|---|---|---|---|---|---|
| 4,026,389 | A | | 5/1977 | Magee | |
| 4,147,235 | A | | 4/1979 | Henry et al. | |
| 4,718,520 | A | * | 1/1988 | Schroder | 187/380 |
| 4,793,443 | A | * | 12/1988 | MacDonald et al. | 187/387 |
| 4,991,694 | A | * | 2/1991 | Friedli | 187/387 |
| 5,168,135 | A | | 12/1992 | Kubo et al. | |
| 5,239,142 | A | * | 8/1993 | Ekholm et al. | 187/387 |
| 5,331,121 | A | | 7/1994 | Tsuji | |
| 5,334,807 | A | | 8/1994 | Kubo et al. | |
| 5,388,668 | A | * | 2/1995 | Powell et al. | 187/387 |
| 5,412,163 | A | | 5/1995 | Tsuji | |
| 5,767,460 | A | * | 6/1998 | Thangavelu | 187/382 |
| 5,841,084 | A | * | 11/1998 | Thangavelu | 187/382 |
| 5,865,274 | A | | 2/1999 | Kiji et al. | |
| 5,955,708 | A | * | 9/1999 | Amano et al. | 187/247 |
| 6,672,431 | B2 | * | 1/2004 | Brand et al. | 187/382 |
| 7,743,890 | B2 | * | 6/2010 | Nikovski et al. | 187/382 |

FOREIGN PATENT DOCUMENTS

| | | | |
|---|---|---|---|
| JP | H08245091 | A | 9/1996 |
| JP | 11335012 | A | 12/1999 |
| JP | 2005112503 | A | 4/2005 |
| JP | 2005330083 | A | 12/2005 |

OTHER PUBLICATIONS

International Search Report and Written Opinion of the International Searching Authority for International application No. PCT/US2010/030678 dated Dec. 29, 2010.

* cited by examiner

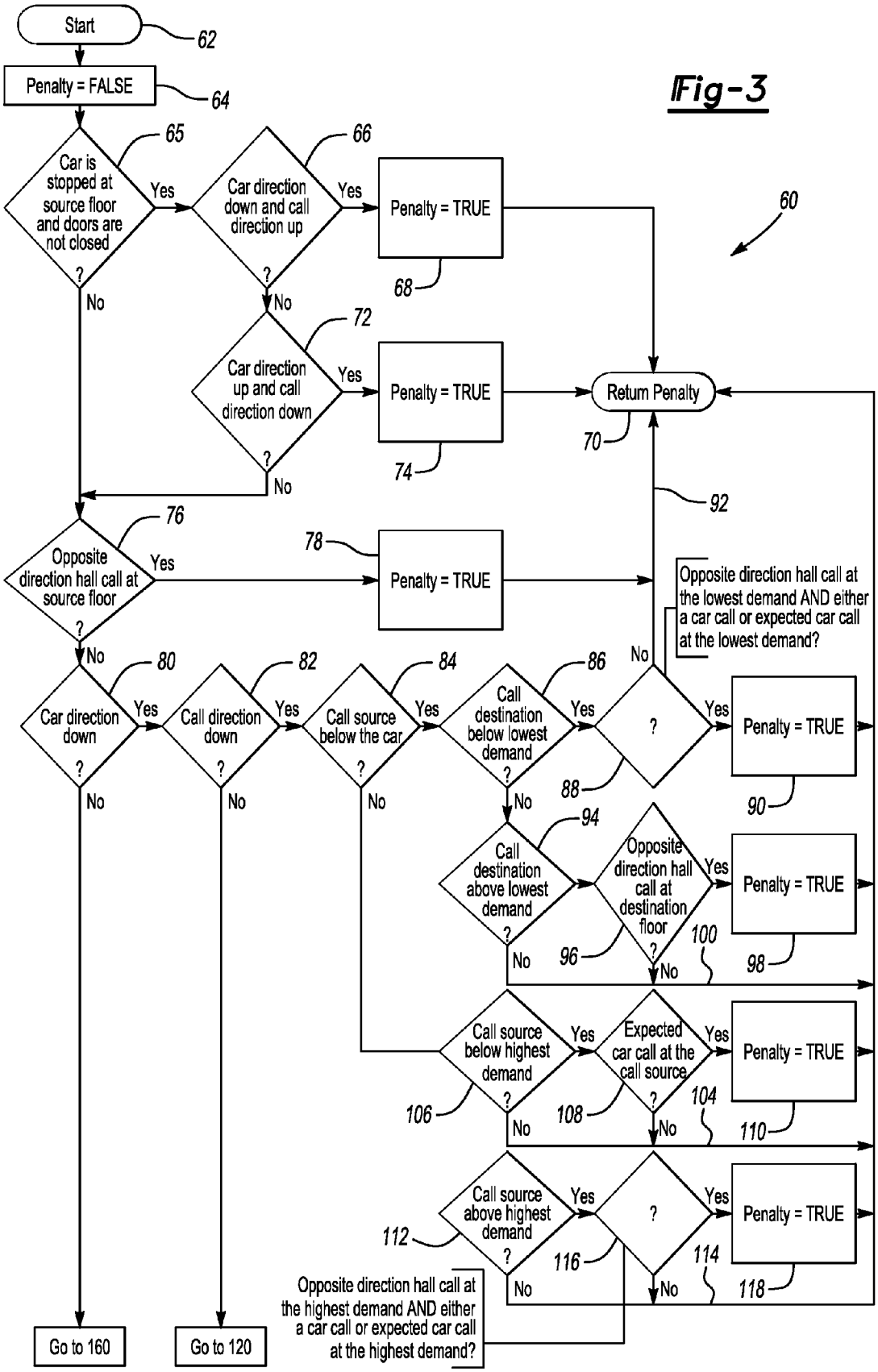
Fig-3
Start
62
Penalty = FALSE
64
Car is stopped at source floor and doors are not closed ?
65
Yes
No
Car direction down and call direction up ?
66
Yes
No
Penalty = TRUE
68
Car direction up and call direction down ?
72
Yes
No
Penalty = TRUE
74
Return Penalty
70
60
92
Opposite direction hall call at source floor ?
76
Yes
No
Penalty = TRUE
78
Car direction down ?
80
Yes
No
Call direction down ?
82
Yes
No
Call source below the car ?
84
Yes
No
Call destination below lowest demand ?
86
Yes
No
?
88
Yes
No
Penalty = TRUE
90
Opposite direction hall call at the lowest demand AND either a car call or expected car call at the lowest demand?
Call destination above lowest demand ?
94
No
Opposite direction hall call at destination floor ?
96
Yes
No
100
Penalty = TRUE
98
Call source below highest demand ?
106
Yes
No
Expected car call at the call source ?
108
Yes
No
104
Penalty = TRUE
110
Call source above highest demand ?
112
Yes
No
?
116
Yes
No
114
Penalty = TRUE
118
Opposite direction hall call at the highest demand AND either a car call or expected car call at the highest demand?
Go to 160
Go to 120

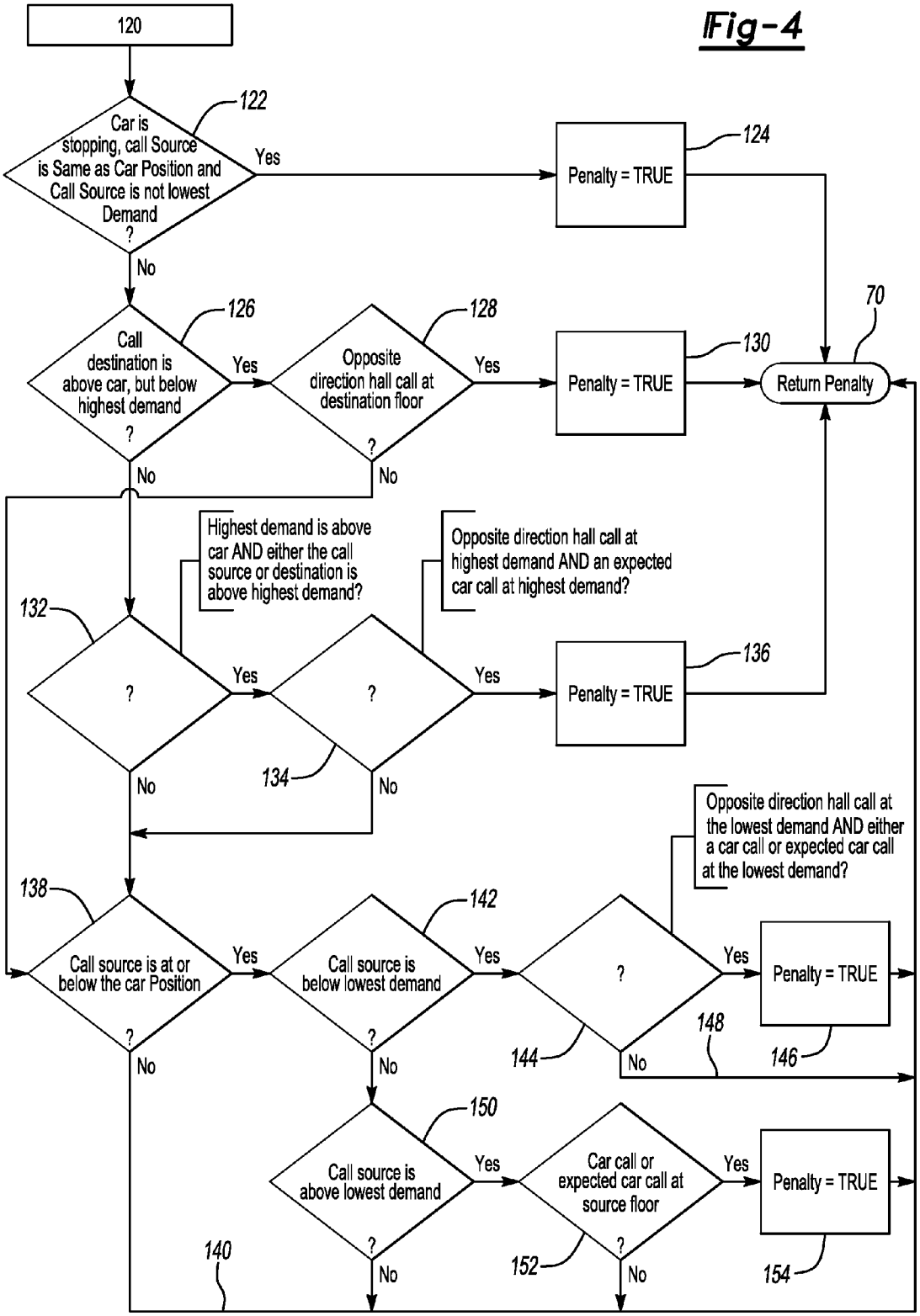
Fig-4
120
122
Car is stopping, call Source is Same as Car Position and Call Source is not lowest Demand ?
Yes
No
124
Penalty = TRUE
126
Call destination is above car, but below highest demand ?
Yes
No
128
Opposite direction hall call at destination floor ?
Yes
No
130
Penalty = TRUE
70
Return Penalty
Highest demand is above car AND either the call source or destination is above highest demand?
Opposite direction hall call at highest demand AND an expected car call at highest demand?
132
?
Yes
No
?
Yes
No
134
136
Penalty = TRUE
Opposite direction hall call at the lowest demand AND either a car call or expected car call at the lowest demand?
138
Call source is at or below the car Position ?
Yes
No
142
Call source is below lowest demand ?
Yes
No
?
Yes
No
144
148
Penalty = TRUE
146
150
Call source is above lowest demand ?
Yes
No
Car call or expected car call at source floor ?
Yes
No
152
Penalty = TRUE
154
140

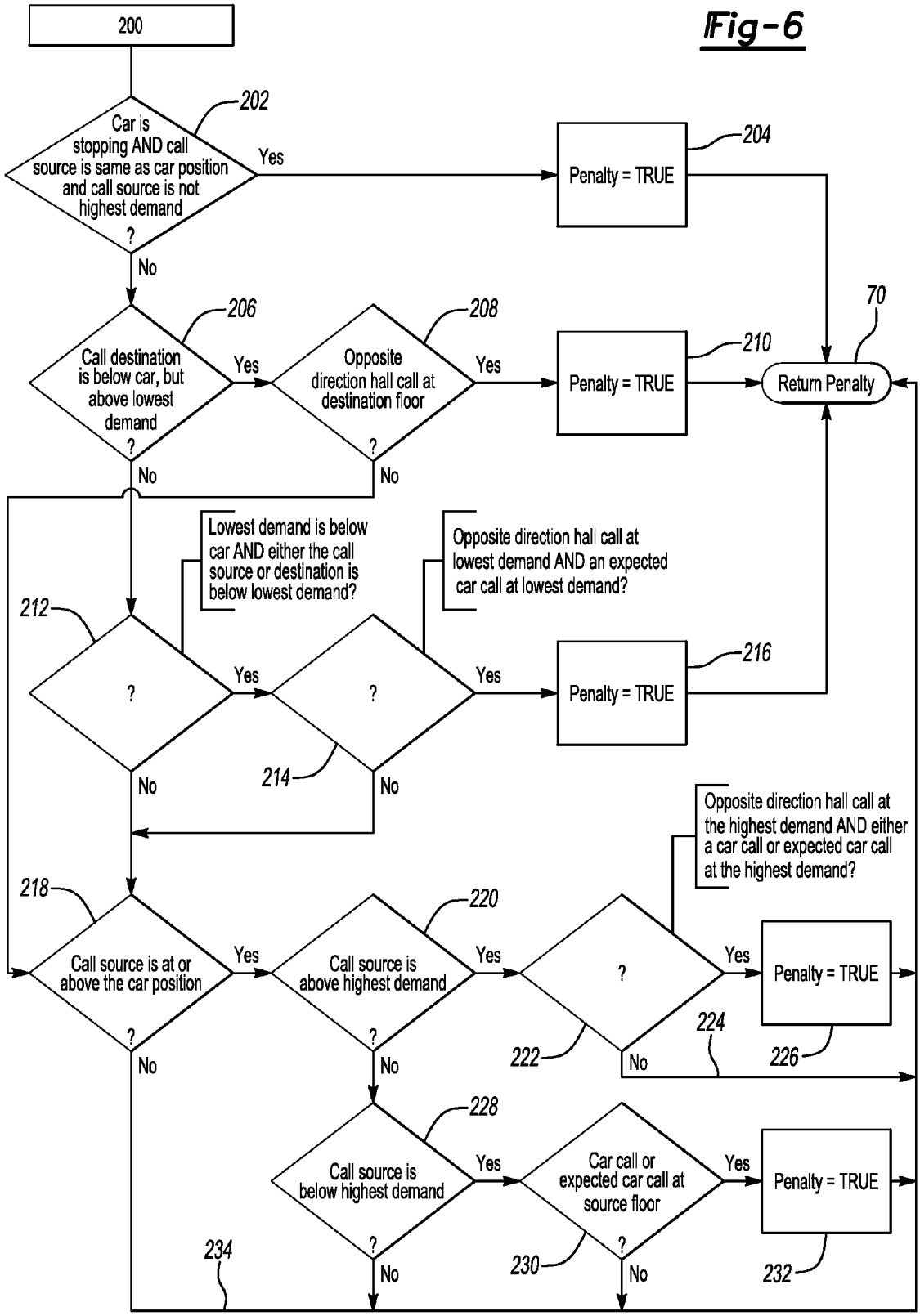
Fig-6
200
202
Car is stopping AND call source is same as car position and call source is not highest demand ?
Yes
No
204
Penalty = TRUE
206
Call destination is below car, but above lowest demand ?
Yes
No
208
Opposite direction hall call at destination floor ?
Yes
No
210
Penalty = TRUE
70
Return Penalty
Lowest demand is below car AND either the call source or destination is below lowest demand?
Opposite direction hall call at lowest demand AND an expected car call at lowest demand?
212
?
Yes
No
214
?
Yes
No
216
Penalty = TRUE
Opposite direction hall call at the highest demand AND either a car call or expected car call at the highest demand?
218
Call source is at or above the car position ?
Yes
No
220
Call source is above highest demand ?
Yes
No
222
?
Yes
No
224
Penalty = TRUE
226
228
Call source is below highest demand ?
Yes
No
230
Car call or expected car call at source floor ?
Yes
No
Penalty = TRUE
232
234

ELEVATOR DISPATCH CONTROL TO AVOID PASSENGER CONFUSION

BACKGROUND

Elevator systems are in widespread use for carrying passengers between various levels in buildings, for example. For many years elevator systems operated based upon hall calls initiated by a passenger pressing a hall call button indicating a desire to be carried up or down from a particular floor. Many such elevator systems include hall lanterns that indicate a direction of movement of an elevator car arriving at a particular landing. The hall lanterns allow a passenger to determine whether they desire to get on a particular car based, in part, on whether that car is heading in the direction that passenger desires to travel.

Modern elevator systems may include a variety of different technologies for allowing passengers to place a call for elevator service. For example, destination entry systems allow a passenger to provide an indication of their intended destination floor before the passenger enters an elevator car. With such systems, a dispatch controller assigns a particular car to service that call. While such systems allow for improved efficiencies in traffic capacity, especially for larger buildings, they introduce certain difficulties in some situations.

For example, many destination entry systems do not have hall lanterns at the entrances to the cars, but instead have some other car indicator to allow a passenger to know which car they are supposed to take. Without a hall lantern indicating the direction that the car is moving, a passenger may get on a car expecting it to go in one direction when, in fact, it will travel in the opposite direction. This can be a source of confusion for passengers.

Such a situation is particularly problematic when a car arrives at the landing where the passenger expects to board an elevator car but that car is not yet traveling in the direction of that passenger's destination. It is possible for the passenger to enter that car and travel in the wrong direction. The car subsequently returns to the landing where the passenger already boarded the car. At that location the system expects the passenger to board the car and uses some sort of sensor for detecting whether somebody entered the car. As the passenger has previously boarded the car, the system assumes that passenger is not there and may cancel the passenger's intended destination. That passenger ends up confused and possibly frustrated because of what appears to the passenger as a malfunction of the elevator system.

SUMMARY

An exemplary method of controlling an elevator system includes determining a source floor of a new call from a passenger desiring elevator service. A direction of travel from the source floor for the new call is also determined. A path of a considered elevator car is simulated as if the new call were assigned to the considered elevator car by determining at least one of (i) a relationship between a position of the considered elevator car and the source floor or (ii) a relationship between a direction of movement of the considered elevator car and the direction of travel. The new call is assigned to one of a plurality of elevator cars if the assigning will satisfy each of (i) the one of the elevator cars will not move in a direction opposite the direction of travel during a time between the passenger boarding the one of the elevator cars and arriving at a destination of the passenger and (ii) the one of the elevator cars will not move in a direction opposite a travel direction of any currently assigned passenger during a time between the currently assigned passenger boarding the one of the elevator cars and arriving at a destination of the currently assigned passenger.

The various features and advantages of an example embodiment will become apparent to those skilled in the art from the following detailed description. The drawings that accompany the detailed description can be briefly described as follows.

BRIEF DESCRIPTION OF THE DRAWINGS

FIG. 3 is a flowchart diagram summarizing an example algorithm for determining which of a plurality of elevator cars will be assigned a particular call.

FIG. 4 is a flowchart diagram showing further details regarding a portion of the example of FIG. 3.

FIG. 6 is a flowchart diagram showing further details of the example of FIG. 5.

DETAILED DESCRIPTION

Figure 1:
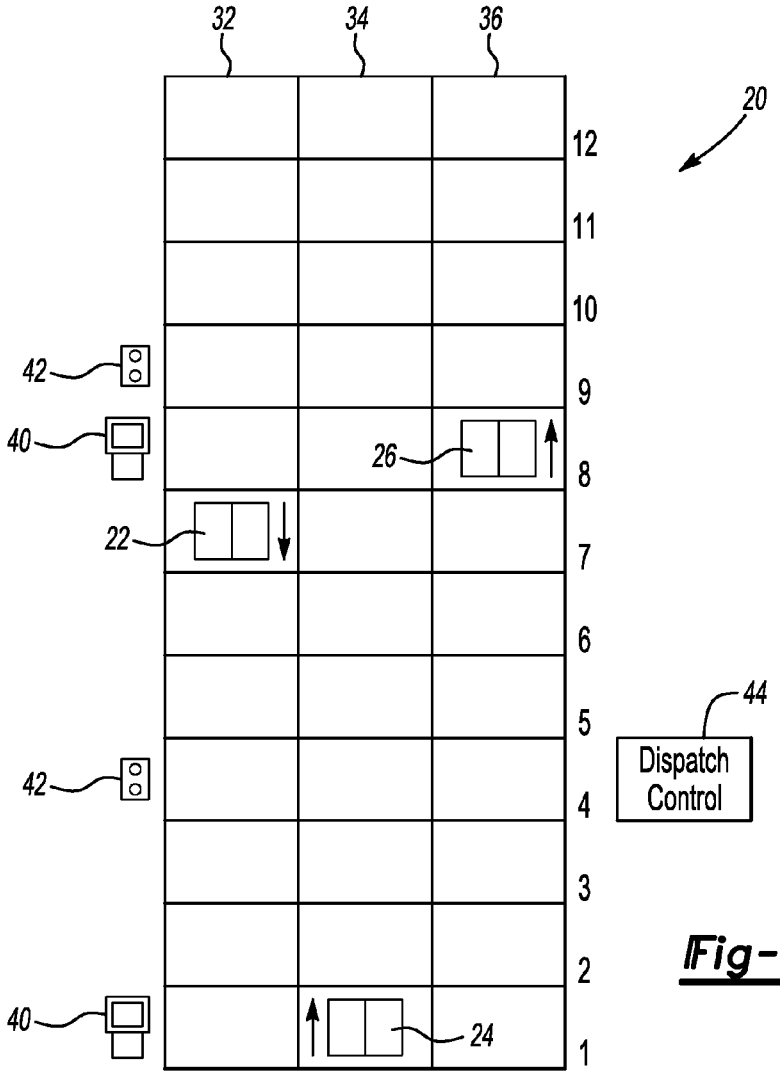
FIG. 1 schematically shows selected portions of an example elevator system.

FIG. 1 schematically shows selected portions of an example elevator system 20. A plurality of elevator cars 22, 24 and 26 are situated for carrying passengers between different building levels schematically shown as levels 1-12 in FIG. 1. Each of the elevator cars 22, 24 and 26 is in a hoistway 32, 34 and 36, respectively. Only three elevator cars are shown for purposes of discussion. Example implementations of this invention can be utilized for any number of elevator cars depending on the needs of a particular situation.

The example of FIG. 1 includes destination entry devices 40 that are configured to allow passengers to request elevator service. The destination entry devices 40 include a passenger interface that allows the passenger to indicate a desired destination while the passenger is outside of an elevator car (e.g., while still in the elevator lobby). Such devices are known. FIG. 1 includes another example passenger input device comprising hall call buttons 42. Hall call buttons allow a passenger at a particular building level to indicate a desire to be carried up or down from that level. Such devices are known.

The example of FIG. 1 includes a dispatch controller 44 that assigns one of the elevator cars 22, 24 or 26 to particular calls depending on a variety of factors. The dispatch controller 44 in this example makes car assignments that minimize the possibility for passenger confusion or frustration by preventing or minimizing the occurrence of a situation in which a passenger boards an elevator car that is headed in a direction opposite to the direction the passenger needs to travel to reach that passenger's intended destination.

Figure 2:
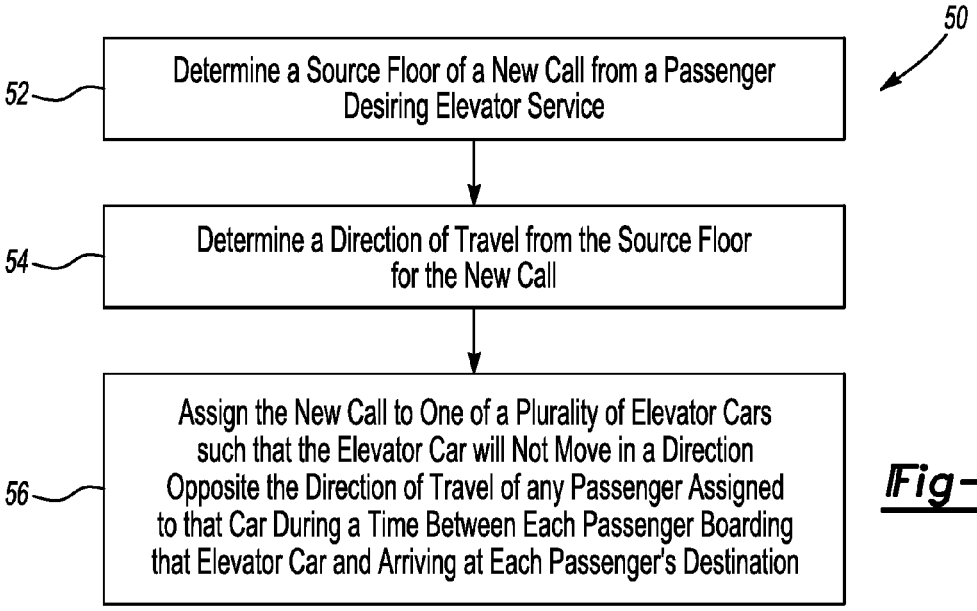
FIG. 2 is a flowchart diagram summarizing one example approach.

FIG. 2 is a flowchart diagram 50 summarizing one example approach. At 52, the dispatch controller 44 determines a source floor of a new call from a passenger desiring elevator service. At 54 a direction of travel from the source floor for the new call is determined. The direction of travel is the direction in which the passenger needs to go to reach the intended destination. The new call may be placed using a variety of types of passenger input devices such as one of the destination entry devices 40 or hall call buttons 42. At 56 the dispatch controller 44 assigns the new call to one of the elevator cars such that the elevator car will not move in a direction opposite the direction of travel for the new call or any currently assigned passenger for that car during a time between each passenger boarding that car and arriving at the passenger's respective destination.

By avoiding a situation in which a passenger will be carried in the direction opposite to the direction they need to travel to reach their intended destination, the disclosed example avoids passenger confusion and frustration. Additionally, the situation in which an elevator controller may mistakenly determine that the passenger has not boarded the elevator car and responsively cancels the request can be avoided.

While there are a variety of algorithms useful for controlling the elevator system 20 so that the dispatch controller 44 makes an assignment according to the example approach summarized in FIG. 2, a particular algorithm is summarized in the flowcharts of FIGS. 3-6. The example flowchart 60 begins in FIG. 3 where the dispatch algorithm is initiated at 62. In this example the algorithm simulates a path of the elevator car under consideration if the new call were assigned to that elevator car. A determination is made whether a condition will exist in which the elevator car travels in a direction opposite to the direction that the passenger placing the new call needs to travel to reach the intended destination. If so, a different one of the elevator cars is considered.

In some examples, it may not be possible to assign the call to any one of the cars without at least some travel in an opposite direction. Under such circumstances, a variety of criteria may be used to select the best one of the elevator cars based upon factors such as shortest wait time, minimum amounts of travel in the opposite direction, minimizing a number of stops for the elevator car or minimizing total elevator car movement, for example. Those skilled in the art who have the benefit of this description will be able to select appropriate criteria to deal with such a situation.

In the example of FIG. 3, a penalty value is initiated at 64. The penalty value in this example indicates whether a candidate car could be assigned the new call. In this example, when the penalty value is FALSE, that indicates that there is no penalty associated with assigning the new call to a particular elevator car. If so, that elevator car is an appropriate candidate to be assigned the new call. Of course, additional criteria may be utilized to select the best of any available candidate cars for a particular new call. The algorithm summarized in the flowchart 60 is intended to simulate the car travel path for each of the considered elevator cars to determine whether it is an appropriate candidate for call assignment. The details of how to select from among more than one available candidate car, if there is more than one, is outside the scope of this disclosure.

A determination is made at 65 whether a candidate elevator car is stopped at the source floor where the new call will originate. In other words, the determination at 65 determines whether a particular elevator car is stopped at the floor from which the passenger desires to board an elevator car. The determination at 65 includes determining whether the car doors are open. As indicated at 66, if the car is stopped at the source floor and the doors are opened, a determination is then made whether the car direction of movement is down and the direction associated with the new call is up. If so, the penalty value is set to TRUE at 68. As soon as the penalty value is TRUE for a particular elevator car, that is returned or reported at 70. In this example, the penalty value of TRUE disqualifies an elevator car from being a candidate for assignment of the new call.

Assuming that the determination at 66 is negative, another determination is made at 72 regarding whether the car direction is up and the call direction is down. If so, the penalty value is set to TRUE at 74. This is then returned or reported at 70.

Assuming the determination at 65 is negative, the next step in the example of FIG. 3 is shown at 76. As can be appreciated from the drawing, the decision at 76 will also be made if the determination at 65 was positive and the determinations at 66 and 72 were negative. At 76, a determination is made whether a hall call at the source floor already exists that requires the car to travel in a direction opposite to that of the new call under consideration. If so, the penalty value is set to TRUE at 78 and that is reported at 70. If the determination at 76 results in a negative conclusion, a decision is made at 80 whether the car direction is down. This car direction is the current direction of movement of the elevator car under consideration. Assuming that it is, another determination is made at 82 whether the direction associated with the new call is also down.

Based upon a positive conclusion at 82, a determination whether the call source is below the current position of the car is made at 84. This is based upon determining the source floor for the new call and the current position of the elevator car under consideration, for example. Assuming that the call source floor is below the elevator car, a determination is made at 86 whether the call destination is below the lowest demand of the current assignments to that particular elevator car. If so, another determination is made at 88 whether there are any opposite direction hall calls at the lowest demand and there is either a current car call or an expected car call at the lowest demand of that elevator car's current run based on current assignments to that car.

When the determination at 88 includes a positive conclusion, that elevator car is not eligible to service that call and the penalty value is set to TRUE at 90. If, on the other hand, the determination at 88 results in a negative conclusion, the penalty value is still FALSE and the algorithm moves along the path shown at 92 where the penalty value is then reported at 70. Under these latter circumstances, the elevator car under consideration is a valid candidate to receive an assignment of the new call under consideration.

Previously a positive outcome at 86 was considered but now assume that the determination made at 86 results in a negative conclusion. The next step in the illustrated example is shown at 94 where a determination is made whether the call destination is above the lowest demand of the elevator car's current run assignments. If so, another determination at 96 includes considering whether there is an opposite direction hall call at the destination floor. When there is, that elevator car is not a valid candidate for the new call and the penalty value is set to TRUE at 98.

If the determination made at 94 or 96 results in a negative conclusion, the example algorithm follows the path shown at 100 and the penalty value of FALSE is reported at 70. Under either of those circumstances, the elevator car is a valid candidate and could be assigned the new call.

The previous discussion assumed that the determination at 84 resulted in a positive conclusion. Assume now that the call source is not below the car and that the conclusion at 84 is negative. Then a determination is made at 106 whether the call source is below the highest demand floor for that elevator car given the current assignments to that car. If so, a determination is made at 108 whether an expected car call exists at the source floor where the new call originates. If so, the penalty is set to TRUE at 110 and that elevator car is not eligible for assignment of the new call. If the determination at 108 is that there is no expected car call at the source of the new call, then the example algorithm follows the path at 104 and the FALSE value for the penalty is reported at 70. Under that circumstance, the elevator car under consideration is a valid candidate for assignment of the new call.

Assume now that the determination at 106 results in a negative conclusion because the call source is not below the highest demand. Then a determination whether the call source is above the highest demand is made at 112. If not, the algorithm follows the path at 114 and the FALSE value for the penalty is reported at 70. If the call source is above the highest demand as determined at 112, then a determination at 116 is made. This determination is whether there is an opposite direction hall call at the highest demand for that car and there is a car call or an expected car call at the highest demand. If the determination at 116 involves a negative conclusion, the path at 114 is followed to report the FALSE value of the penalty. If, on the other hand, the determination at 116 results in a positive conclusion, then the penalty is set to TRUE at 118 and that elevator car is not an eligible candidate for assignment of the new call.

The discussion above assumed that the determination made at 82 resulted in a positive conclusion (i.e., that the car direction was down and the call direction was down). Assume now that the determination at 82 results in a negative conclusion because the call direction is up while the car direction as determined at 80 is down. Under these circumstances, the steps summarized in FIG. 4 will be followed as indicated by the connector 120 in FIG. 3.

As shown in FIG. 4, a determination is made at 122 whether the elevator car under consideration is stopping, the source of the new call is the same as the car position and the call source is not equal to the lowest demand. If so, the penalty value is set to TRUE at 124 and then reported at 70. If the conditions at 122 are not satisfied, then a determination is made at 126 whether the destination of the new call is above the car but below the highest demand on the car given the car's current assignments. If so, then a determination is made at 128 whether there is an opposite direction hall call at the destination floor. When the determination at 128 yields a positive result, the penalty value is set to TRUE at 130 and then returned at 70.

If the determination made at 126 yields a negative result, then a determination is made at 132 whether the highest demand is above the car and either the call source or the destination of the new call is above the highest demand. If so, the example at FIG. 4 proceeds to 134 where a determination is made whether there is an opposite direction hall call at the location of the highest demand and an expected car call at the highest demand. If so, then the penalty value is set to TRUE at 136.

If the determinations made at any one of 128, 132 or 134 yields a negative result, then a decision is made at 138 whether the call source is at or below the car's position. If not, the algorithm proceeds along the path shown at 140 to return the penalty value of FALSE, which means that the elevator car is a valid candidate for possible assignment of the new call. On the other hand, when the call source is at or below the car's position as determined at 138, the next determination is made at 142 to determine if the call source is below the lowest demand. When it is, a determination is made at 144 whether there is an opposite direction hall call at the lowest demand and a car call or an expected car call is also at the lowest demand. When those conditions are met, the penalty value is set to TRUE at 146. When the determination at 144 yields a negative result, the penalty value of FALSE is reported because the path at 148 is followed up to the penalty reporting step 70.

Referring back to the decision at 142, when the call source is not below the lowest demand of the elevator car, the next determination is made at 150 whether the call source is above the lowest demand. If not, the path at 140 is followed and the penalty value FALSE is reported at 70. When, on the other hand, the call source is above the lowest demand, a determination at 152 indicates whether there is a car call or an expected car call at the source floor of the new call. If so, the penalty value is set to TRUE at 154. If the determination at 152 yields a negative result, then the path at 140 is followed and the penalty value of FALSE is reported at 70 because the elevator car under consideration is a candidate for assignment of the new call.

Each of the steps followed in FIG. 4 were undertaken under the assumption that the determination at 80 in FIG. 3 yielded a positive result and the determination at 82 yielded a negative result. Under some circumstances, the determination made at 80 whether the car direction is down will be negative because the car is heading upward. Under these conditions, the determinations shown in the flowchart of FIG. 5 will be undertaken by following the path to the connector 160.

Figure 5:
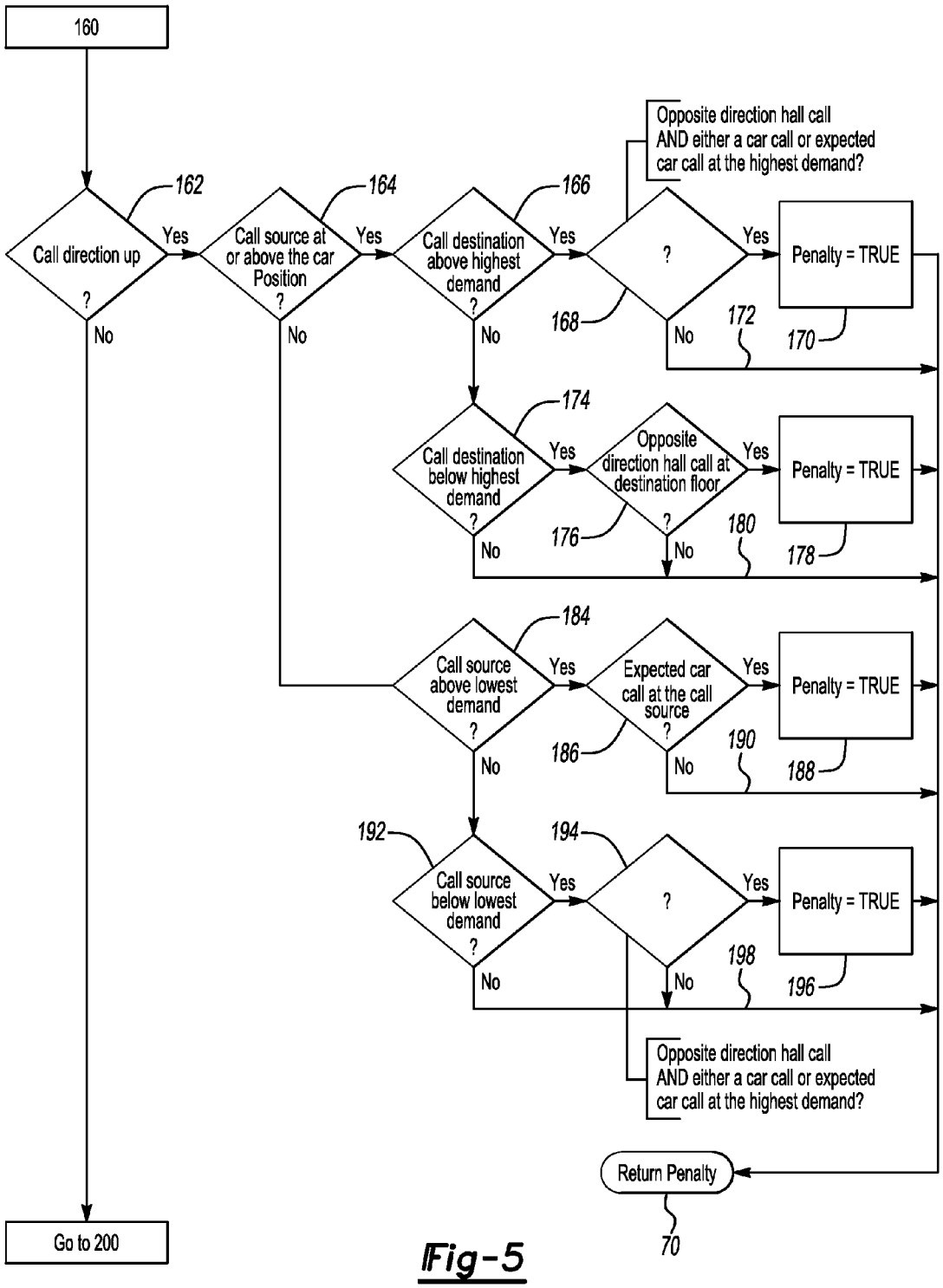
FIG. 5 is a flowchart diagram showing further details of a portion of the example of FIG. 3.

In FIG. 5 the first determination is shown at 162. At this point a determination is made whether the call direction is up, which would mean the call direction is the same as the car direction in this example. If so, a determination at 164 indicates whether the call source is at or above the car's position. If yes, the next step is to determine at 166 whether the call destination is above the highest demand on the car given the car's current assignments. When the call destination is above that highest demand, a determination is made at 168 whether there is an opposite direction hall call and either a car call or an expected car call at the highest demand. If so, the penalty value is set to TRUE at 170. When the determination at 168 yields a negative result, the example of FIG. 5 follows the path shown at 172 and the penalty value of FALSE is reported at 70. That condition indicates that the elevator car under consideration is a valid candidate for assignment of the new call.

Looking back to the decision at 166, if the call destination is not above the highest demand, a determination is made at 174 whether the call destination is below the highest demand. If it is, a determination at 176 indicates whether there is an opposite direction hall call at the destination floor. If so, the penalty value is set to TRUE at 178 and that is reported at 70. If the determination made at 174 or 176 yields a negative result, the car under consideration is a valid candidate for assignment of the new call and the path at 180 in FIG. 5 would be followed.

The steps 166-178 would be undertaken if the determination at 164 yielded a positive result. When, however, the call source is not above the car as determined at 164, the next determination is made at 184 whether the call source is above the lowest demand. When the result at 184 is positive, a decision is made at 186 whether there is an expected car call at the call source floor. If so, the penalty value is set to TRUE at 188. If, on the other hand, the determination made at 186 yields a negative result, the path at 190 would be followed and the penalty value of FALSE would be reported at 70.

When the determination at 184 regarding the call source being above the lowest demand yields a negative result, the illustrated example proceeds to 192. Here a determination is made whether the call source is below the lowest demand on the elevator car. If so, a determination at 194 indicates whether there is an opposite direction hall call and either a car call or an expected car call at the lowest demand. When those conditions are satisfied, the penalty value is set to TRUE at 196 and the car is not considered eligible for the new call. If, on the other hand, the determination made at 192 or 194 yields a negative result, the path shown at 198 would be followed and the elevator car would be considered a valid candidate for that new call.

The steps 164-196 shown in FIG. 5 would be followed according to the above description when the determination at 162 indicates that the call direction is up. If, on the other hand, the call direction is down, the example algorithm proceeds to the connector 200 so that the procedure summarized in FIG. 6 provides an indication of car eligibility for assignment.

As shown in FIG. 6, assuming a negative determination at 162 (FIG. 5) a determination is made at 202 is whether the car is stopping, the call source is the same floor as the car position and the call source is not the highest demand. If so, the penalty value is set to TRUE at 204 and reported at 70. If, on the other hand, the conditions at 202 are not satisfied, then a determination is made at 206 whether the call destination is below the car but above the lowest demand on the car. If so, a determination is made at 208 whether there is an opposite direction hall call at the destination floor. When that is the case, the penalty value is set to TRUE at 210. The elevator car would not be considered a valid candidate at that point and the penalty value is returned at 70.

When the determination at 206 yields a negative result, another determination at 212 is made whether the lowest demand on the car is below the car and either the call source or the destination of the new call is below that lowest demand. When those conditions are met, a determination is made at 214 whether there is an opposite direction hall call and there is an expected car call at the lowest demand location. Under those conditions, the penalty value is set to TRUE at 216.

If the determination made at 208, 212 or 214 yields a negative result, the next step in the illustrated example is shown at 218. At this point a determination is made whether the call source is at or above the car's position. When it is, the determination at 220 indicates whether the call source is above the highest demand. When the decision at 220 yields a positive result, a determination is made at 222 whether there is an opposite direction hall call along with either a car call or an expected car call at the highest demand. When those conditions are satisfied, the elevator car should not be considered a valid candidate for assignment of the new call and the penalty value is set to TRUE at 226. When the determination at 222 yields a negative result, on the other hand, the penalty value is still FALSE and that is reported at 70 by following the path indicated at 224.

Looking back to the decision at 220, when the call source is not above the highest demand, the illustrated example includes a decision at 228 regarding whether the call source is below the highest demand. When it is, another decision at 230 indicates whether the car call or an expected car call exists at the source floor. If so, the penalty value is set to TRUE at 232. When the determination made at 230, 228 or 218 yields a negative result, the path shown at 234 in FIG. 6 would be followed to report the penalty value of FALSE at 70. Under any of those conditions, the elevator car under consideration could be assigned the new call.

As one example scenario, assume that a new call is placed on floor 8 in FIG. 1 using the destination entry device 40. The new call includes an indication from the passenger that the desire is to travel up to floor 12. For purposes of discussion, the elevator car 22 is currently at floor 7 and traveling downward to the first floor with no intermediate stops. The elevator car 24 is traveling from the first floor up to the seventh floor with an intermediate stop at floor 5. The elevator car 26 is currently stopped at floor 8 with its doors open for purposes of answering a hall call in the up direction. The passenger placing that hall call enters the car 26 and indicates a desire to travel to floor 10.

Now considering the example algorithm summarized in FIGS. 3-6, the elevator car 22 is considered first. Beginning at 62 in FIG. 3, the penalty value for car 22 is currently set at FALSE according to the step 64. The determination at 65 yields a negative result because the car is not stopped at the source floor. The next step is 76 where a determination is made whether there is an opposite direction hall call at the source floor. The result of that inquiry is negative and a determination is made at 80 whether the car direction is down. The elevator car 22 is currently traveling from floor 7 to the first floor. So the answer to the inquiry at 80 is yes and the determination is made at 82 whether the call direction is down. In this example, the call direction would be up as the passenger desires to go from floor 8 to floor 12. Accordingly, the connector 120 is followed into FIG. 4. The determination at 122 is negative because the car is not stopping and the call source is not the same as the car position. The next determination at 126 yields a negative result because the call destination of the new call is above the car but not below the highest demand on the car. This would require following the flow of FIG. 4 to the step 132. The result of that determination would be negative because the highest demand on the car 22 is not above the car. This would lead to the determination at 138 where a determination is made whether the call source is below the car. In this example, the call source is floor 8 and the elevator car 22 is currently at floor 7. Therefore, the determination at 138 would be negative and the penalty value remains FALSE, which is reported at 70. In other words, the elevator car 22 is a valid candidate for assignment of the new call because assigning the call to it would not result in an opposite direction of movement of the elevator car 22 from the direction of travel required by the passenger placing the new call during the time between when the passenger would board the elevator car 22 and arrive at the destination floor 12. Under the example scenario, the elevator car 22 will return to the first floor before the passenger on floor 8 could board the car. The car 22 could then travel upward to handle the new call.

Considering the car 24 and starting with the determination at 65 in FIG. 3, the car 24 is not stopped at the source floor. Therefore, the next determination is made at 76 where the question must be answered whether there is an opposite direction hall call at the source floor. Under the assumed circumstances, there is not so the next inquiry is made at 80. The direction of the elevator car 24 is up, therefore, the result would be to go to the connector 160 and proceed with the algorithm in FIG. 5. The next determination would be whether the call direction is up as shown at 162. The answer to that question is yes so the next determination is whether the call source is above the car at 164. Given that the call sources is floor 8 and the car 24 is at the first floor, the result of the determination at 164 is positive. The next question is answered at 166 whether the call destination is above the highest demand on the car 24. The answer to that question is yes. The next determination is made at 168 whether an opposite direction hall call is at the highest demand (e.g., floor seven) and there is either a car call or an expected car call at the highest demand. The answer to that question under the assumed circumstances is no and the path shown at 172 would be followed. In other words, the elevator car 24 is a valid candidate for assignment of the new call in this scenario.

Turning to the elevator car 26 and referring to FIG. 3, the determination at 65 yields a positive result because the car 26 is stopped at the source floor of the new call and the car doors are currently opened. The next determination is made at 66 whether the car direction is down and the call direction is up. Given that the elevator car 26 is moving up, the answer is no and the next determination must be made at 72. In this case, the car direction is up and the call direction is up so that a negative result occurs at the determination made at 72. This requires following the path to the determination at 76. Given the assumed scenario, there is no opposite direction hall call at the eighth floor. The next determination is then made at 80 whether the car direction is up or down. In this case, the car 26 is moving up so the flow continues to the connector at 160. The determination is then made at 162 (FIG. 5) whether the call direction is up. Given that the passenger desires to go from floor eight to floor twelve, the answer to the inquiry at 162 is yes.

A determination at 164 indicates whether the call source is at or above the car's position. Given that the car and the call source are both on the eighth floor, a positive result takes the flow to the determination at 166. In this case, the call destination is in fact above the highest demand, which yields a positive result. The flow continues to the connector 168 where a determination is made whether an opposite direction hall call along with either a car call or expected car call exists at the current highest demand. Since only a car call exists, the answer to that question is no and the path shown at 172 would be followed to report the FALSE penalty value at 70. The elevator car 26 is a valid candidate for the new call.

Given that all three example cars could be assigned the new call, other criteria will be used to choose one of those cars. Under the given circumstances according to one example, it is most likely to assign the new call to the elevator car 26 because that will provide the shortest wait time for the passenger. The car 26 is already on the eighth floor and the passenger could conceivably board that car immediately. If for some reason it would appear not likely that the passenger could board that car (e.g., the car is already fully loaded), the elevator car 24 is likely the next best choice because it is likely to arrive at the eighth floor to pick up the passenger placing the new call before the elevator car 22 could get there. Other criteria may be used to select between available candidate cars. Given this description, those skilled in the art will be able to arrange appropriate criteria to meet their particular needs for such situations.

If any of the cars 22, 24 or 26 were situated such that the corresponding penalty value for that car were set to TRUE when following the path of the illustrated flowcharts, that car would be eliminated from consideration and not be a candidate car. Such a car would travel in a direction opposite the direction of travel required by the new call between the time when the passenger would board that car and arrive at the new call destination.

The illustrated example provides a technique of controlling an elevator system in a manner that avoids passenger confusion and frustration by reducing or eliminating opposite travel conditions during which a passenger would enter an elevator car and be carried in a direction opposite the direction they expect to travel to reach their desired destination.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system, comprising the steps of:

determining a direction of travel from a source floor of a new call from a passenger desiring elevator service;

simulating a path of a considered elevator car if the new call were assigned to the considered elevator car by determining at least one of the following relationships:

(i) a relationship between a position of the considered elevator car and the source floor or (ii) a relationship between a direction of movement of the considered elevator car and the direction of travel; and assigning the new call to one of a plurality of elevator cars if the assigning will satisfy each of (i) the one of the elevator cars will not move in a direction opposite the direction of travel during a time between the passenger boarding the one of the elevator cars and arriving at a destination of the passenger, and (ii) the one of the elevator cars will not move in a direction opposite a travel direction of any currently assigned passenger during a time between the currently assigned passenger boarding the one of the elevator cars and arriving at a destination of the currently assigned passenger.

2. The method of claim 1, comprising assigning the new call to the one of the plurality of elevator cars if the assigning will not result in the one of the elevator cars stopping at a source floor of the currently assigned passenger and subsequently moving in a direction opposite a direction from the source floor of the currently assigned passenger to the destination of the currently assigned passenger.

3. The method of claim 2, comprising determining at least one of whether either the source floor of the new call or the destination of the new call is either above or below either a highest demand or a lowest demand on a considered elevator car;

whether a considered elevator car has a call waiting at either the source floor or the destination;

whether a considered elevator car has a hall call waiting at the source floor, the hall call having a direction of movement opposite the direction of travel; or whether a considered elevator car has a call or an expected call waiting at either a highest demand on the considered elevator car or a lowest demand on the considered elevator car.

4. The method of claim 1, comprising determining whether a considered elevator car is at the source floor;

determining whether the considered elevator car will move in a direction opposite the direction of travel; and designating the considered elevator car as ineligible for assignment of the new call when the considered elevator car is at the source floor and will move in the direction opposite the direction of travel.

5. The method of claim 1, comprising determining whether the direction of travel is the same as a direction of movement of a considered elevator car; and determining whether the source floor is above or below the considered elevator car.

6. The method of claim 5, wherein the direction of travel is the same as the direction of movement of the considered elevator car, the method comprising designating the considered elevator car as a candidate for assignment of the new call when the source floor is not below the considered elevator car and the source floor is not above the considered elevator car.

7. The method of claim 5, wherein the direction of travel and the direction of movement are both down and the source floor is below the considered elevator car, the method comprising determining whether the destination of the new call is above or below a lowest demand on the considered elevator car; and at least one of (i) designating the considered elevator car as a valid candidate for assignment of the new call if the destination of the new call is not below or above the lowest demand;

(ii) designating the considered elevator car as a valid candidate for assignment of the new call if the destination of the new call is below the lowest demand and either there is no opposite direction hall call at the lowest demand or there is no car call or expected car call at the lowest demand;

(iii) designating the considered elevator car as ineligible for assignment of the new call if the destination of the new call is below the lowest demand and there is an opposite direction hall call at the lowest demand and there is a car call at the lowest demand or an expected car call at the lowest demand;

(iv) designating the considered elevator car as a valid candidate for assignment of the new call if the destination of the new call is above the lowest demand and there is no opposite direction hall call at the destination of the new call; or (v) designating the considered elevator car as ineligible for assignment of the new call if the destination of the new call is above the lowest demand and there is an opposite direction hall call at the destination of the new call.

8. The method of claim 5, wherein the direction of movement and the direction of travel are both down and the source floor is above the considered elevator car, the method comprising determining whether the source floor is above or below a highest demand on the considered elevator car; and at least one of (i) designating the considered elevator car as a valid candidate for assignment of the new call if the source floor of the new call is not below or above the highest demand;

(ii) designating the considered elevator car as a valid candidate for assignment of the new call if the source floor of the new call is below the highest demand and there is no expected car call at the source floor;

(iii) designating the considered elevator car as ineligible for assignment of the new call if the source floor of the new call is below the highest demand and there is an expected car call at the source floor;

(iv) designating the considered elevator car as a valid candidate for assignment of the new call if the source floor of the new call is above the highest demand and there is either no opposite direction hall call at the highest demand or no car call at the highest demand or no expected car call at the highest demand; or (v) designating the considered elevator car as ineligible for assignment of the new call if the source floor of the new call is above the highest demand and there is an opposite direction hall call at the highest demand and there is either a car call or an expected car call at the highest demand.

9. The method of claim 5, wherein the direction of travel and the direction of movement are both up and the source floor is at or above the considered elevator car, the method comprising determining whether the destination of the new call is above or below a highest demand on the considered elevator car; and at least one of (i) designating the considered elevator car as a valid candidate for assignment of the new call if the destination of the new call is not below or above the highest demand;

(ii) designating the considered elevator car as a valid candidate for assignment of the new call if the destination of the new call is below the highest demand and there is no hall call at the destination, the hall call having a direction opposite the direction of travel;

(iii) designating the considered elevator car as ineligible for assignment of the new call if the destination of the new call is below the highest demand and there is a hall call at the destination, the hall call having a direction opposite the direction of travel;

(iv) designating the considered elevator car as a valid candidate for assignment of the new call if the destination of the new call is above the highest demand and there is no hall call at the highest demand on the considered elevator car, the hall call having a direction opposite the direction of travel or there is no car call at the highest demand or there is no expected car call at the highest demand; or (v) designating the considered elevator car as ineligible for assignment of the new call if the destination of the new call is above the highest demand and there is a hall call at the highest demand on the considered elevator car, the hall call having a direction opposite the direction of travel and there is a car call or an expected car call at the highest demand.

10. The method of claim 5, wherein the direction of travel and the direction of movement are both up and the source floor is below the considered elevator car, the method comprising determining whether the source floor is above or below a lowest demand on the considered elevator car; and at least one of (i) designating the considered elevator car as a valid candidate for assignment of the new call if the source floor of the new call is not below or above the lowest demand;

(ii) designating the considered elevator car as a valid candidate for assignment of the new call if the source floor of the new call is above the lowest demand and there is no expected car call at the source floor;

(iii) designating the considered elevator car as ineligible for assignment of the new call if the source floor of the new call is above the lowest demand and there is an expected car call at the source floor;

(iv) designating the considered elevator car as a valid candidate for assignment of the new call if the source floor of the new call is below the lowest demand and either there is no hall call at the lowest demand, the hall call having a direction opposite the direction of travel or there is no car call at the lowest demand or there is no expected car call at the lowest demand; or (v) designating the considered elevator car as ineligible for assignment of the new call if the source floor of the new call is below the lowest demand and there is a hall call at the lowest demand, the hall call having a direction opposite the direction of travel and there is either a car call or an expected car call at the lowest demand.

11. The method of claim 5, wherein the direction of travel is different than the direction of movement, the method comprising at least one of designating the considered elevator car a valid candidate for assignment of the new call if the source floor is above the considered elevator car when the direction of travel is up and the direction of movement is down;

designating the considered elevator car a valid candidate for assignment of the new call if the source floor is below the considered elevator car when the direction of travel is down and the direction of movement is up.

12. The method of claim 5, wherein the direction of travel is up, the direction of movement is down and the source floor is below the considered elevator car, the method comprising determining whether the source floor is above or below the lowest demand on the considered elevator car; and at least one of (i) designating the considered elevator car a valid candidate for assignment of the new call if the call source is not below the lowest demand and not above the lowest demand;

(ii) designating the considered elevator car a valid candidate for assignment of the new call if the source floor is below the lowest demand and there is no hall call at the lowest demand, the hall call having a direction opposite the direction of travel, or there is no car call or no expected car call at the lowest demand;

(iii) designating the considered elevator car ineligible for assignment of the new call if the source floor is below the lowest demand and there is a hall call at the lowest demand, the hall call having a direction opposite the direction of travel, and there is either a car call or an expected car call at the lowest demand;

(iv) designating the considered elevator car a valid candidate for assignment of the new call if the source floor is above the lowest demand and there is no car call or no expected car call at the source floor; or (v) designating the considered elevator car ineligible for assignment of the new call if the source floor is above the lowest demand and there is a car call or an expected car call at the source floor.

13. The method of claim 5, wherein the direction of travel is down, the direction of movement is up and the source floor is above the considered elevator car, the method comprising determining whether the source floor is above or below the highest demand on the considered elevator car; and at least one of (i) designating the considered elevator car a valid candidate for assignment of the new call if the call source is not below the lowest demand and not above the highest demand;

(ii) designating the considered elevator car a valid candidate for assignment of the new call if the source floor is above the highest demand and there is no hall call having a direction opposite the direction of travel or there is no car call at the highest demand or no expected car call at the highest demand;

(iii) designating the considered elevator car ineligible for assignment of the new call if the source floor is above the highest demand and there is a hall call having a direction opposite the direction of travel, and there is either a car call at the highest demand or an expected car call at the highest demand;

(iv) designating the considered elevator car a valid candidate for assignment of the new call if the source floor is below the highest demand and there is no car call or no expected car call at the source floor; or (v) designating the considered elevator car ineligible for assignment of the new call if the source floor is below the highest demand and there is a car call or an expected car call at the source floor.

14. The method of claim 1, comprising determining that the direction of travel and a direction of movement of a considered elevator car are different; and designating the considered elevator car as ineligible for assignment of the new call if the considered elevator car is stopping at a source floor of the new call.

15. The method of claim 1, comprising determining that the direction of travel and a direction of movement of a considered elevator car are different;

determining whether the destination of the new call is either (a) above the considered elevator car and below a highest demand on the considered elevator car or (b) below the considered elevator car and above a lowest demand on the considered elevator car; and designating the considered elevator car as ineligible for assignment of the new call if there is a hall call at the destination, the hall call having a direction opposite the direction of travel, and the destination satisfies the conditions of (a) or (b).

16. The method of claim 1, comprising determining that the direction of travel and a direction of movement of a considered elevator car are different;

determining whether the destination of the new call is either (i) above the considered elevator car and below a highest demand on the considered elevator car or (ii) below the considered elevator car and above a lowest demand on the considered elevator car; and at least one of designating the considered elevator car as ineligible for assignment of the new call if (a) a lowest demand on the considered elevator car is below the considered elevator car and either the source floor or the destination is below the lowest demand and (b) there is a hall call at the lowest demand, the hall call having a direction opposite the direction of travel, and there is an expected car call at the lowest demand; or designating the considered elevator car as ineligible for assignment of the new call if (a) a highest demand on the considered elevator car is above the considered elevator car and either the source floor or the destination is above the highest demand and (b) there is a hall call at the highest demand, the hall call having a direction opposite the direction of travel, and there is an expected car call at the highest demand.

17. An elevator system, comprising:

a plurality of elevator cars;

at least one passenger input device configured to allow a passenger to place a new call for elevator service; and a dispatch controller configured to determine a direction of travel from a source floor of a new call from a passenger desiring elevator service;

simulate a path of a considered elevator car if the new call were assigned to the considered elevator car by determining at least one of the following relationships:

(i) a relationship between a position of the considered elevator car and the source floor or (ii) a relationship between a direction of movement of the considered elevator car and the direction of travel; and assign the new call to one of the plurality of elevator cars if the assigning will satisfy each of (i) the one of the elevator cars will not move in a direction opposite the direction of travel during a time between the passenger boarding the one of the elevator cars and arriving at a destination of the passenger, and (ii) the one of the elevator cars will not move in a direction opposite a travel direction of any currently assigned passenger during a time between the currently assigned passenger boarding the one of the elevator cars and arriving at a destination of the currently assigned passenger.

* * * * *